US009429895B2

(12) United States Patent
Teraji et al.

(10) Patent No.: US 9,429,895 B2
(45) Date of Patent: Aug. 30, 2016

(54) CLEANING DEVICE AND IMAGE FORMING APPARATUS

(71) Applicants: Hajime Teraji, Kanagawa (JP); Hiromichi Ninomiya, Kanagawa (JP); Takeshi Kojima, Kanagawa (JP); Michiya Okamoto, Kanagawa (JP); Takuma Iwasaki, Tokyo (JP); Shinya Karasawa, Kanagawa (JP); Daisuke Sawada, Kanagawa (JP); Kentaroh Nodera, Kanagawa (JP); Masanori Moro, Kanagawa (JP)

(72) Inventors: Hajime Teraji, Kanagawa (JP); Hiromichi Ninomiya, Kanagawa (JP); Takeshi Kojima, Kanagawa (JP); Michiya Okamoto, Kanagawa (JP); Takuma Iwasaki, Tokyo (JP); Shinya Karasawa, Kanagawa (JP); Daisuke Sawada, Kanagawa (JP); Kentaroh Nodera, Kanagawa (JP); Masanori Moro, Kanagawa (JP)

(73) Assignee: RICOH COMPANY, LIMITED, Tokyo (JP)

( * ) Notice: Subject to any disclaimer, the term of this patent is extended or adjusted under 35 U.S.C. 154(b) by 0 days.

(21) Appl. No.: 14/610,036

(22) Filed: Jan. 30, 2015

(65) Prior Publication Data

US 2015/0234341 A1 Aug. 20, 2015

(30) Foreign Application Priority Data

Feb. 19, 2014 (JP) ..... 2014-029510
Jun. 30, 2014 (JP) ..... 2014-134341

(51) Int. Cl.
*G03G 21/00* (2006.01)
*B08B 1/00* (2006.01)
*B08B 1/04* (2006.01)

(52) U.S. Cl.
CPC ..... *G03G 21/0029* (2013.01); *B08B 1/005* (2013.01); *B08B 1/007* (2013.01); *B08B 1/04* (2013.01); *G03G 21/0076* (2013.01); *G03G 21/0035* (2013.01); *G03G 2215/1661* (2013.01)

(58) Field of Classification Search
CPC ..... G03G 21/0029; G03G 21/007; G03G 21/0005; G03G 21/0076; G03G 2215/1661; G03G 2221/001; G03G 2221/0089; B08B 1/005; B08B 1/007; B08B 1/04
See application file for complete search history.

(56) References Cited

U.S. PATENT DOCUMENTS 6,249,665 B1 * 6/2001 Yuge et al. ..... 399/358
7,835,683 B2 11/2010 Muraishi et al.

(Continued)

FOREIGN PATENT DOCUMENTS

JP 2000-147973 5/2000
JP 2000-181310 6/2000

(Continued)

*Primary Examiner* — Sandra Brase
(74) *Attorney, Agent, or Firm* — Harness, Dickey & Pierce, P.L.C.

(57) ABSTRACT

A cleaning device comprises: a to-be-cleaned member; a cleaning member that cleans the surface of the to-be-cleaned member; a conveying member that conveys a substance removed from the surface of the to-be-cleaned member to outside of the device; a rotatable collecting member that conveys with its surface the substance toward the conveying member; and a partitioning member that guides the substance from the collecting member to the conveying member. The collecting member comprises a conveying portion that carries and conveys the substance; and a protrusion that protrudes toward an upstream side of the conveying portion in a rotating direction of the collecting member. One end of the partitioning member faces the rotating collecting member, and the other end faces the conveying member. The conveying portion and the protrusion are brought into contact with the partitioning member by the rotation of the collecting member.

20 Claims, 7 Drawing Sheets

(56) References Cited

U.S. PATENT DOCUMENTS

| | | | | |
|---|---|---|---|---|
| 2002/0025202 | A1* | 2/2002 | Itaya et al. | 399/350 |
| 2010/0074665 | A1 | 3/2010 | Okamoto et al. | |
| 2010/0316422 | A1 | 12/2010 | Amemiya et al. | |
| 2014/0093295 | A1 | 4/2014 | Kojima et al. | |
| 2014/0126942 | A1 | 5/2014 | Kojima et al. | |
| 2014/0233997 | A1 | 8/2014 | Asaoka et al. | |

FOREIGN PATENT DOCUMENTS

| | | |
|---|---|---|
| JP | 2001-060054 | 3/2001 |
| JP | 2002-072805 | 3/2002 |
| JP | 2004-101816 | 4/2004 |
| JP | 2009-134169 | 6/2009 |
| JP | 2011-018004 | 1/2011 |

* cited by examiner

"Conventional Art"

CLEANING DEVICE AND IMAGE FORMING APPARATUS

CROSS-REFERENCE TO RELATED APPLICATIONS

The present application claims priority to and incorporates by reference the entire contents of Japanese Patent Application No. 2014-029510 filed in Japan on Feb. 19, 2014 and Japanese Patent Application No. 2014-134341 filed in Japan on Jun. 30, 2014.

BACKGROUND OF THE INVENTION

1. Field of the Invention

The present invention relates to a cleaning device and an image forming apparatus such as a copier, a printer, a facsimile, or a multifunction peripheral having two or more of the functions of the copier, the printer, and the facsimile and is provided with the cleaning device.

2. Description of the Related Art

In an image forming apparatus such as a copier, a printer, a facsimile, or a multifunction peripheral including two or more of the functions of the copier, the printer, and the facsimile, the toner is left behind on the surface of a photoconductor or an intermediate transfer belt that are examples of a member to be cleaned, after the toner is transferred onto a transfer sheet.

A cleaning device is provided in the image forming apparatus to remove such remaining substances from the surface of the member to be cleaned. Some cleaning devices include a cleaning member for removing the remaining substances from the surface of the member to be cleaned, and a conveying member for conveying the removed remaining substances outside of the cleaning device.

According to the disclosure in Japanese Patent Application Laid-open No. 2004-101816, once transfer is completed, a cleaning blade 201, a cleaning brush 202, and a brush roller 203 abutting against a cleaned body 200 scrape off the toner T remaining on the surface of the cleaned body 200, as illustrated in FIG. 15. The scraped toner T is conveyed from the cleaning blade 201 to the brush roller 203, and conveyed further to the cleaning brush 202.

A flicker 204 abutting against the cleaning brush 202 flicks off the toner T remaining in the cleaning brush 202 from the cleaning brush 202 into a waste toner conveying coil 205, and the waste toner conveying coil 205 conveys the toner outside of the cleaning device.

A partitioning member 206 is positioned between the cleaning brush 202 and the waste toner conveying coil 205. When the flicker 204 flicks the toner T off from the cleaning brush 202, the partitioning member 206 prevents the toner T having not reached the waste toner conveying coil 205 from flying away and being scattered again on the cleaned body 200 and the like. This structure allows the cleaning device to remove more toner from the cleaned body 200.

With the invention disclosed in Japanese Patent Application Laid-open No. 2004-101816, however, the toner T flicked by the flicker 204 may fly away to directions other than the waste toner conveying coil 205, and land on the surface of the cleaned body 200 again without reaching the partitioning member 206, so that the toner T is not collected very efficiently.

In view of the above-mentioned problem, there is a need to provide a cleaning device capable of cleaning the toner and the like on the surface of the cleaned body more efficiently.

SUMMARY OF THE INVENTION

It is an object of the present invention to at least partially solve the problems in the conventional technology.

According to the present invention, there is provided a cleaning device comprising: a member to be cleaned having a surface that moves; a cleaning member that cleans the surface of the member to be cleaned; a conveying member that conveys a substance removed from the surface of the member to be cleaned by the cleaning member to outside of the cleaning device; a collecting member that is rotatably configured, has a surface for carrying the substance, and conveys the substance toward the conveying member; and a partitioning member that guides the substance from the collecting member to the conveying member, the collecting member comprising: a conveying portion that carries and conveys the substance; a holding portion that holds the conveying portion; and a protrusion that protrudes toward an upstream side of the conveying portion in a rotating direction of the collecting member, wherein the partitioning member is placed in such a manner that one end of the partitioning member faces the rotating collecting member, and the other end faces the conveying member, and the conveying portion and the protrusion of the collecting member are brought into contact with the partitioning member by the rotation of the collecting member.

The present invention also provides an image forming apparatus comprising the above-mentioned cleaning device The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
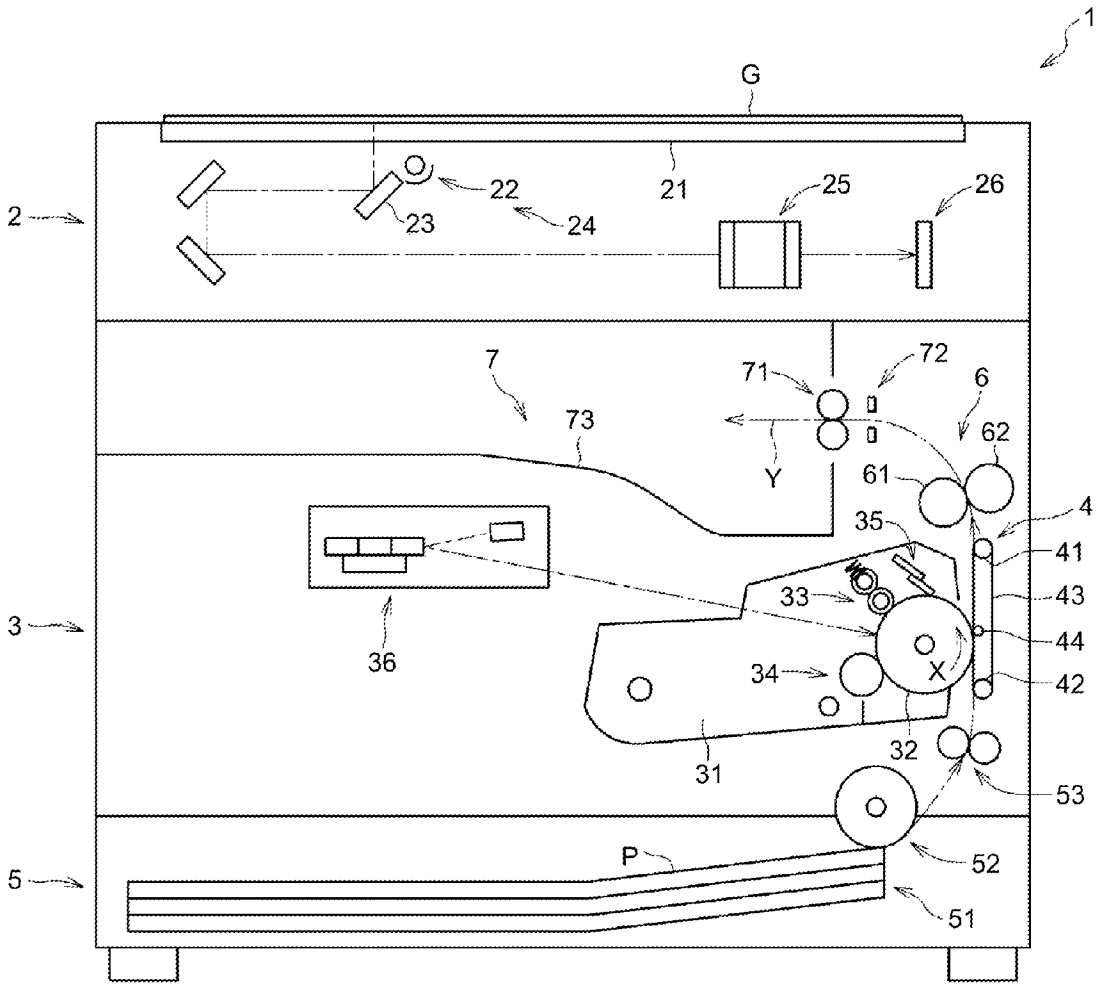
FIG. 1 is a schematic illustrating a general structure of an image forming apparatus according to an embodiment of the present invention.

Some embodiments of the present invention will now be explained with reference to some drawings. In the drawings, the same or equivalent portions are assigned with the same reference numerals, and redundant explanations thereof are simplified or omitted as appropriate.

As illustrated in FIG. 1, an image forming apparatus 1 includes an image reading unit 2, an image forming unit 3, a transfer unit 4, a sheet feeding unit 5, a fixing unit 6, and an ejecting unit 7.

The image reading unit 2 includes a contact glass 21 on which an original is placed, a reading carriage 24 provided with a light source 22 and an optical path conversion reflecting mirror 23 for reading an image of the original G placed on the contact glass 21, a reading optical system 25 including a lens transmitting reflected light from the original, the reflected light being formed by the reading carriage 24, and an optical element 26 such as a charge-coupled device (CCD) on which the light transmitted through the reading optical system 25 becomes incident and that reads the incident light as an image signal.

The image forming unit 3 is positioned below the image reading unit 2, and includes a process cartridge 31 that is removably mounted on the image forming apparatus 1. The process cartridge 31 includes a photoconductor 32 being a member to be cleaned of which surface can carry toner, a charging roller 33 that charges the surface of the photoconductor 32 uniformly, a developing unit 34 that supplies toner to the surface of the photoconductor 32, and a cleaning device 35 for cleaning the surface of the photoconductor 32.

A writing unit 36 is positioned on the left side of the process cartridge 31 in FIG. 1, at a position enabled to irradiate the photoconductor 32 with a laser.

The transfer unit 4 is positioned adjacent to the process cartridge 31 in FIG. 1. The transfer unit 4 includes an endless belt 43 rotatably stretched across a driving roller 41 and a driven roller 42, and a facing roller 44 positioned facing the photoconductor 32 with the belt 43 positioned therebetween. The facing roller 44 is pressed against the internal circumferential surface of the belt 43, thereby forming a transfer nip with the photoconductor 32, at a position where the pressed portion of the belt 43 is brought into contact with the photoconductor 32.

The sheet feeding unit 5 is positioned at the bottom of the image forming apparatus 1, and includes a sheet feeding cassette 51 storing therein recording sheets P serving as recording media, and a sheet feeding roller 52 for feeding the recording sheets P from the sheet feeding cassette 51.

A conveying path Y for guiding a recording sheet P from the sheet feeding unit 5 to the ejecting unit 7 is provided with its most upstream end positioned at the sheet feeding unit 5. In addition to a registration roller pair 53, conveying roller pairs not illustrated are provided as appropriate along the conveying path Y leading to the ejecting unit 7.

The fixing unit 6 includes a fixing roller 61 including an internal heat source, and a pressing roller 62 capable of pressing the fixing roller 61.

The ejecting unit 7 is positioned on the most downstream side of the conveying path Y in the image forming apparatus 1. Disposed in the ejecting unit 7 are a sheet ejection roller pair 71 for ejecting the recording sheet P to the outside, a sheet ejection sensor 72 for detecting passage of the recording sheet P, and a sheet ejection tray 73 for storing the ejected recording sheet P.

A basic operation of the image forming apparatus 1 will now be explained with reference to FIG. 1.

As the image reading unit 2 reads an original, the image information of the original read by the optical element 26 is output to a control unit (not illustrated) and digitized.

Based on the image information from the control unit, the writing unit 36 irradiates the photoconductor 32 with a laser L, and the photoconductor 32 is exposed thereby.

When the image forming operation is started, the photoconductor 32 is caused to rotate, to move the outer circumferential surface of the photoconductor 32 in the direction of the arrow X in FIG. 1. The surface of the photoconductor 32 is then uniformly charged with the charging roller 33, and an electrostatic latent image is formed on the surface of the photoconductor 32 through the exposure. By allowing an electrostatic latent image to be formed on the photoconductor 32 and allowing the toner stored in the developing unit 34 to be supplied onto the photoconductor 32, the electrostatic latent image is visualized as a toner image (developer image) that is a visible image.

When the image forming operation is started, the sheet feeding roller 52 in the sheet feeding unit 5 is driven in rotation, and feeds the top recording sheet P in the sheet feeding cassette 51 into the conveying path Y. The recording sheet P fed into the conveying path Y is sent onto the belt 43 by the registration rollers 53.

Before conveying the recording sheet P, the surface of the belt 43 is charged by a charger (not illustrated). This allows the belt 43 to convey the recording sheet P stably, by electrostatically adsorbing the recording sheet P, onto the surface of the belt 43.

The fed recording sheet P is conveyed by the belt 43 to a position at which the photoconductor 32 and the facing roller 44 face each other, and a toner image is transferred from the photoconductor 32 onto the recording sheet P.

At the time of transfer, a constant-voltage or constant-current controlled voltage, controlled to the opposite polarity of the polarity to which the toner is charged, is applied to the facing roller 44. A transfer field is generated thereby in the transfer nip between the facing roller 44 and the photoconductor 32, and the toner image on the photoconductor 32 is transferred onto the recording sheet P.

After the image transfer, some toner remain and are attached on the surface of the photoconductor 32. The cleaning device 35 therefore removes the remaining toner from the surface of the photoconductor 32, and the photoconductor 32 performs the image forming operation again.

The registration rollers 53 feed the recording sheet P onto the belt 43 at such timing that the leading end of the toner image on the surface of the photoconductor 32 overlaps with the leading end of the position where the image is to be formed on the fed recording sheet P.

The recording sheet P after the toner image is transferred is conveyed into the fixing unit 6. The recording sheet P is then heated and pressed by the fixing roller 61 heated by the heat source and the pressing roller 62, and the toner image is fixed onto the recording sheet P. The recording sheet P on which the toner image is fixed is then separated from the fixing roller 61, and further conveyed by conveying roller pairs not illustrated. The recording sheet P is then ejected onto the sheet ejection tray 73 by the sheet ejection roller 71 in the ejecting unit 7.

When the recording sheet P is ejected onto the sheet ejection tray 73, the sheet ejection sensor 72 positioned upstream of the sheet ejection roller 71 detects the ejection of the sheet, and the timings for conveyance and ejection of the next recording sheet P, transfer of an image onto the recording sheet P, and the like are controlled.

Figure 2:
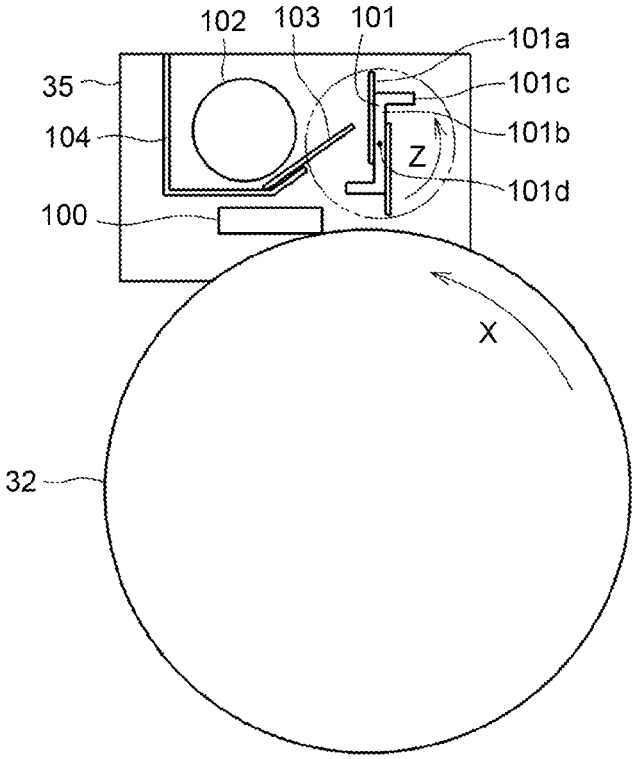
FIG. 2 is a cross-sectional view illustrating a general structure of a cleaning device according to a first embodiment of the present invention.

FIG. 2 is a schematic illustrating a general structure of the cleaning device according to the first embodiment. The cleaning device collects toner, paper powder, and the like as substances to be removed from the surface of the photoconductor 32.

The cleaning device 35 according to the present invention is positioned above the photoconductor 32, and includes a cleaning blade 100 serving as a cleaning member for cleaning the photoconductor 32, a collection vane 101 serving as a collecting member for collecting the substances to be removed such as toner from the cleaning blade 100, a conveying coil 102 serving as conveying member for conveying the substances to be removed to the outside, and a partitioning member 103 positioned between the collection vane 101 and the conveying coil 102.

The cleaning blade 100 is a member positioned extending along the axial direction of the photoconductor 32, and is made of an elastic material such as rubber. An upstream end of the cleaning blade 100, being upstream in the rotating direction X of the photoconductor 32, abuts against the photoconductor 32, and is placed in a manner held against the photoconductor 32. By allowing the cleaning blade 100 to abut against the photoconductor 32, the toner remaining on the surface of the photoconductor 32 after the transfer is scraped off, and is accumulated in the abutment part of the cleaning blade 100.

On the upstream side of the cleaning blade 100, being upstream in the rotating direction X, the collection vane 101 is provided. The collection vane 101 includes vanes 101*a* serving as conveying portions that collect and convey the toner removed by the cleaning blade 100, a holding portion 101*b* for holding the vanes 101*a*, and protrusions 101*c* protruding on the upstream side of the holding portion 101*b*, being upstream in a rotating direction Z of the collection vane 101.

In a structure in which the cleaning blade 100 is placed above the photoconductor 32, such as that in the image forming apparatus 1 according to the present invention, it is difficult to collect the toner removed by the cleaning blade 100 by allowing the toner to fall into a waste toner container or the like by the force of gravity. The collection vane 101 is therefore provided.

The collection vane 101 is provided rotatably (movably along a surface) in the direction of the arrow Z, about a rotational axis 101*d* extending in parallel with the photoconductor 32. The sheet-like vanes 101*a* are mounted on both surfaces of the holding portion 101*b*. The holding portion 101*b* has protrusions 101*c* each of which protrudes from the corresponding end of the holding portion 101*b* toward the upstream side of the rotating direction Z of the collection vane 101, and has an S-like shape, with its ends bent by 90 degrees.

The holding portion 101*b* may be made of a material such as metal or resin, and the vane 101*a* may be made of a material such as metal, resin, or elastic rubber.

The collection vane 101 is rotated in the direction of the arrow Z about the rotational axis 101*d*, and the surface facing the photoconductor 32 is rotated (surface-moved) in the counter direction of the rotating direction X of the photoconductor 32. When the toner at the end of the cleaning blade 100 piles up to a certain level or higher and enters the rotational area of the collection vane 101, the accumulated toner is collected by the vane 101*a*, and the rotational movement of the collection vane 101 conveys the toner in the direction of the arrow Z.

Because the collection vane 101 collecting the toner at the end of the cleaning blade 100 is rotated in the counter direction of the rotation of the photoconductor 32, the collection vane 101 is prevented from pushing the toner accumulated at the end of the cleaning blade 100 deeper into the cleaning unit 35 (in the direction of the arrow X).

Figure 3:
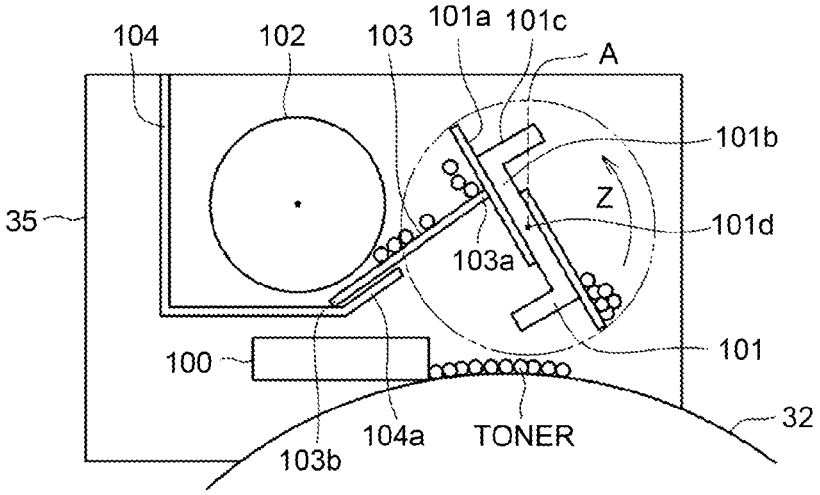
FIG. 3 is a schematic illustrating how the toner is collected in the cleaning device.

FIG. 3 is a schematic illustrating how the toner on surface of the photoconductor 32 accumulates at the cleaning blade 100, is collected and conveyed by the collection vane 101, and is guided by the partitioning member 103 to the conveying coil 102.

The partitioning member 103 is formed of a flexible polyurethane sheet, and is arranged in such a manner that one end 103*a* of the partitioning member 103 is in contact with the rotating vane 101*a*, and the other end 103*b* faces the conveying coil 102 and inclined toward the conveying coil 102. The toner is therefore carried along the inclined surface of the partitioning member 103 toward the other end 103*b*. The other end 103*b* is placed immediately below the conveying coil 102. This configuration enables the conveying coil 102 to collect the toner carried to the other end 103*b* efficiently. By positioning the other end 103*b* immediately below the conveying coil 102, the length of the partitioning member 103 can be reduced to the minimum length required to convey the toner, so that a certain level of strength or higher of the partitioning member 103 can be ensured.

The other end 103*b* of the partitioning member 103, the other end 103*b* being positioned near the conveying coil 102, is fixed to a support 104*a* of a housing 104 of the cleaning device 35, and a part of the other end 103*b* of the partitioning member 103 is supported by the support 104*a*. By allowing the support 104*a* to support the part, the direction at which the partitioning member 103 is placed can be stabilized. In this manner, the rotating collection vane 101 can come into contact with the partitioning member 103 at an appropriate angle, and the toner conveyed to the partitioning member 103 can be further conveyed toward the other end 103*b* appropriately.

The support 104*a* is inclined along the outer circumferential surface of the conveying coil 102, and this inclination allows the conveying coil 102 to collect the toner more efficiently.

Explained now is the process how the toner collected by the collection vane 101 is carried to the conveying coil 102.

The toner is conveyed by the rotating collection vane 101, and lifted upwardly from the lower position at which the cleaning blade 100 is placed. Once the vane 101*a* passes through the apex A of the rotation, the vane 101*a* moves downwardly from that point on, and the toner carried on the surface of the vane 101*a* falls from the vane 101*a*.

The toner then lands on the partitioning member 103 that is brought into contact with the collection vane 101, and the fallen toner is guided along the inclined surface of the partitioning member 103, and carried to the conveying coil 102.

After carrying the toner on its surface and dropping the toner onto the partitioning member 103, the collection vane 101 keeps rotating, and presses the partitioning member 103. The pressing force of the collection vane 101 causes the partitioning member 103, which is flexible, to warp. When the collection vane 101 is rotated further, the pressing force against the partitioning member 103 is released, and the partitioning member 103 bounces back to the original shape. At this time, with the force causing the partitioning member 103 to bounce back to the original shape, the toner remaining on the surface of the partitioning member 103 is flicked toward the conveying coil 102. As the collection vane 101 is rotated further, the protrusion 101*c* protruding toward the upstream side of the rotating direction Z of the collection vane 101 abuts against the partitioning member 103, with some delay from the vane 101*a*, and presses the partitioning member 103. This pressing force allows the toner on the partitioning member 103 to be conveyed into the conveying coil 102 again. In this manner, because the partitioning member 103 is pressed again by the protrusion 101*c*, the toner can be collected more efficiently.

In the embodiment of the present invention, the collection vane 101 is provided with two vanes 101*a*, so that the toner is conveyed twice as the collection vane 101 is rotated once. Alternatively, three or more vanes 101*a* may be provided by increasing the surfaces of the holding portion 101*b* on which the vane 101*a* is held.

In the embodiment of the present invention, the protrusion 101*c* is explained to protrude from the holding portion 101*b* toward the upstream side of the rotating direction Z, but the protrusion 101*c* may protrude from the vane 101*a*. In such a configuration, the vane 101*a* may have an L shape with a protrusion protruding on the side of the holding portion 101*b*, and the protrusion 101*c* may be allowed to press the partitioning member 103 continuously after the vane 101*a* presses the partitioning member 103, and to push the toner toward the conveying coil 102.

When the collection vane 101 is brought into contact with the partitioning member 103, the collection vane 101 presses down the partitioning member 103 in such a direction that the partitioning member 103 is pressed against the housing of the cleaning device 35. This pressing force of the collection vane 101 acts in a direction in which the partitioning member 103 is fixed against the cleaning device 35.

The conveying coil 102 has a coil portion that conveys toner along the axial direction of the photoconductor 32 and the like, from the front side toward the rear side in FIG. 3. The toner carried into the conveying coil 102 is axially conveyed by the coil portion of the conveying coil 102 to the outside of the cleaning device 35.

Through this process, the cleaning device 35 discharges the toner accumulated at the cleaning blade 100 to the outside via the conveying coil 102.

The shape of the vane 101*a* is formed in a rectangle, viewing in the axial direction of the collection vane 101. Alternatively, the vane 101*a* may be formed into an L shape or a shape bent twice, with a protrusion protruding in the opposite direction of the protrusion 101*c* and protruding toward the side abutting against the partitioning member 103 from the leading end where the toner is collected and that abuts against the partitioning member 103. Such a structure allows the vane 101*a* to hold better thereon the toner collected from the photoconductor 32.

According to the present invention, the photoconductor 32 is installed so as not to be in direct contact with the collection vane 101, and the photoconductor 32 does not come into the area of rotation of the vanes 101*a*. Although the toner can be collected more reliably by bringing the collection vane 101 into contact with the photoconductor 32, such a contact might cause the photoconductor 32 to vibrate, and to result in defective image formation such as shock jitter. Thus, the photoconductor 32 is not brought into contact with the collection vane 101, so that the photoconductor 32 is not caused to vibrate and result in defective image formation.

By using a flexible material such as rubber for the partitioning member 103, the vibrations caused by contacting between the collection vane 101 and the partitioning member 103 is reduced, and the defective image formation is prevented.

The vibrations caused when the collection vane 101 is into contact with the partitioning member 103 can also be reduced by using a flexible material for the vanes 101*a* on the collection vane 101. The vanes 101*a*, however, are also required to have some rigidity because the vanes 101*a* need to collect the accumulated toner, to carry and to convey the toner on the surface thereof.

The partitioning member 103 flicks off the toner from its surface toward the conveying coil 102 by becoming warped as the partitioning member 103 is brought into contact with the vane 101*a*, and by bouncing back to the original shape as the pressing force of the vane 101*a* is released. Thus, the partitioning member 103 is required to have some flexibility.

According to the present invention, the vane 101*a* is formed of a polyethylene terephthalate (PET) sheet so that higher rigidity of the vane 101*a* is ensured than that of the partitioning member 103. The partitioning member 103 may be formed of a polyurethane sheet.

The toner may be collected with a brush-shaped roller instead of the collection vane 101. While the toner accumulated at the cleaning blade 100 can be collected more efficiently with a brush, a brush also presents another challenge to overcome, e.g., the collected toner is less easily removed from the brush. The structure according to the embodiment is therefore more preferable. The toner collection efficiency can also be improved by providing a brush or a foamed material only to the leading end of the collection vane 101. By providing a brush or a foamed material to the leading end of the collection vane 101, shock jitter is less produced even when the leading end is brought into contact with the photoconductor 32.

Figure 4:
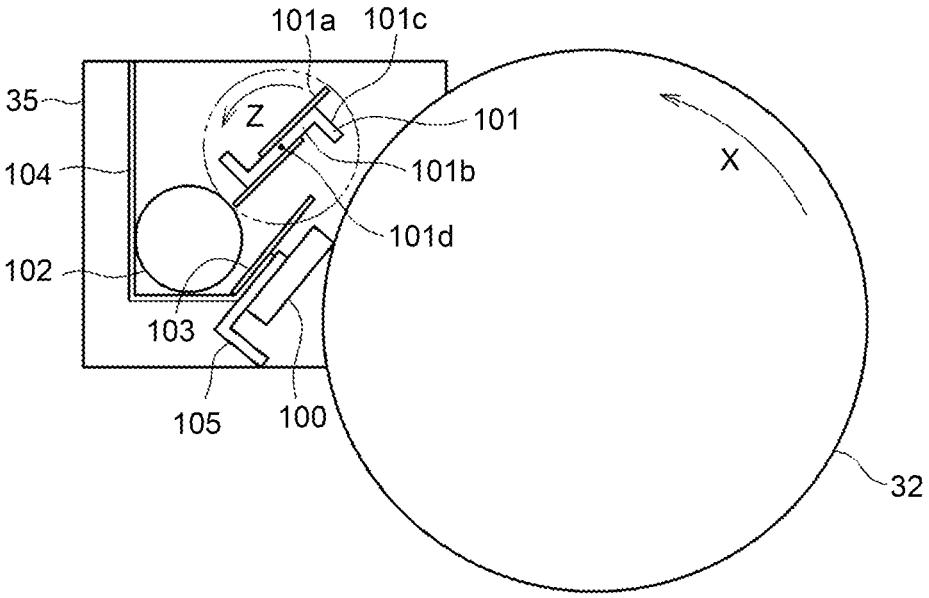
FIG. 4 is a schematic of a cleaning device according to a second embodiment of the present invention.

FIG. 4 illustrates a cleaning device according to a second embodiment of the present invention.

While the cleaning device according to the first embodiment is installed above the photoconductor 32, the cleaning device according to the second embodiment is installed on the right or the left side of the photoconductor 32 (on the left side in FIG. 4).

In the configuration according to the second embodiment, the conveying coil 102 can be positioned below the collection vane 101. By positioning the conveying coil 102 below the collection vane 101, the toner can be collected more easily from the collection vane 101 into the conveying coil 102 by allowing the toner to fall by the force of gravity. The toner can therefore be collected more efficiently.

Because the collection vane 101 is positioned above the partitioning member 103, the partitioning member 103 receiving the falling toner can occupy a larger portion of the area in which the toner may fall from the collection vane 101.

Figure 5:
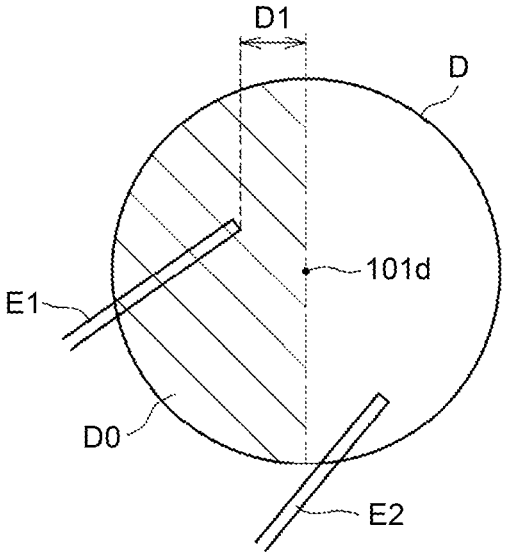
FIG. 5 is comparative schematic of a partitioning member according to the first embodiment and that according to the second embodiment.

As illustrated in FIG. 5, an area D0 in which the toner may fall occupies a left half of the circle representing an area D in which the collection vane 101 is rotated. Let us now compare the ratio occupied by the area in which the partitioning member E2 according to the second embodiment can receive the fallen toner with respect to the entire area D0 in which the toner may fall, with that with the partitioning member E1 according to the first embodiment. While the partitioning member E1 does not extend beyond the rotational axis 101*d* and has a gap in a length D1 with respect to the rotational axis 101*d* in the right-and-left direction as illustrated in FIG. 5, the partitioning member E2 extends beyond the rotational axis 101*d*, and is positioned below the area D0 in which the toner may fall. The partitioning member E2 has therefore no gap. For these reasons, the partitioning member E2 is capable of collecting the toner falling from the collection vane 101 more reliably.

In the configuration according to the first embodiment in which the collection vane 101 is placed directly beside the conveying coil 102 and the partitioning member 103 is brought into contact with the collection vane 101, there is a limitation in the length by which the partitioning member 103 can be extended. The partitioning member 103 therefore cannot be extended toward the rotational axis 101*d*, and the gap in the length D1 is formed.

By contrast, in the configuration according to the second embodiment in which the collection vane 101 is placed above the conveying coil 102, because there is no such a limitation, the partitioning member 103 can be extended to receive the fallen toner with a wider area. Therefore, the toner can be collected more reliably.

The conveying coil 102 may be placed below the collection vane 101 in the configuration of the cleaning device according to the first embodiment in which the cleaning device 35 is placed above the photoconductor 32. There is, however, a requirement that the collection vane 101 needs to be placed near the photoconductor 32 because the collection vane 101 collects the toner from the surface of the photoconductor 32. In order to achieve such a configuration, therefore, one of the following modifications is required. The size of the conveying coil 102 may be reduced so that the conveying coil 102 can be placed between the collection vane 101 and the photoconductor 32 according to the first embodiment; or the size of the collection vane 101 may be increased so that a sufficient space is ensured between the collection vane 101 and the photoconductor 32 to allow the conveying coil 102 to be placed between the collection vane 101 and the photoconductor 32 even when the collection vane 101 moves near the photoconductor 32. The conveying coil 102 according to the former modification, however, lacks the conveying capacity, and the configuration according to the latter modification results in an increased size of the cleaning device 35. It is therefore more preferable to position the conveying coil 102 below the collection vane 101 in the configuration in which the cleaning device 35 is placed on the right or the left side of the photoconductor 32.

A blade holder 105 holds the cleaning blade 100 according to the second embodiment. The blade holder 105 may also hold the partitioning member 103. In such a configuration, because the housing 104 does not need to have a structure for holding the partitioning member 103, the layout of the components can be selected more freely, and the sizes of the unit can be reduced.

Another issue addressed by the present invention will now be explained.

In addition to the toner, paper powder from the recording sheets is another substance to be removed from the surface of the photoconductor 32 by the cleaning blade 100. Because paper powder has extremely small particles in the order of nanometers, the paper powder alone can easily pass through the cleaning blade 100 and flow into the downstream side. When the toner accumulates at the leading end of the cleaning blade 100, the toner can serve to stop the flow of the paper powder, advantageously. If the paper powder passes through the cleaning blade 100, and a large amount becomes attached on the charging roller 33 positioned on the downstream side, defective charging might cause defective image formation.

Defective image formation resulting from the toner accumulated at leading end of the cleaning blade 100 can be prevented by providing the cleaning device 35 in the manner disclosed herein to remove the toner accumulated at leading end of the cleaning blade 100. The paper powder, however, may cause some defects, as mentioned above. This trouble is particularly prominent at the axial ends of the photoconductor 32, because the ends are almost unused in the image formation, and therefore toner is not directly carried on their surface. Explained now are some embodiments of the cleaning device 35 intended to address this issue.

Figure 6:
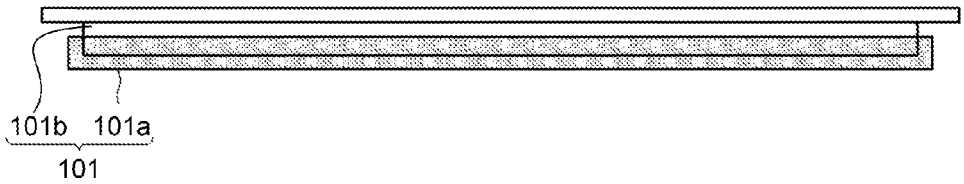
FIG. 6 is a schematic of a cleaning device according to a third embodiment of the present invention.

FIG. 6 is a schematic of a collection vane according to a third embodiment of the present invention.

In the collection vane 101 according to the third embodiment, the axial ends of the vane 101*a* are extended longer than the holding portion 101*b*, and are not supported by the holding portion 101*b*.

Because the ends of the vane 101*a* are not supported by the holding portion 101*b*, when the vane 101*a* scrapes off the toner accumulated at the leading end of the cleaning blade 100, the toner pushes the ends of the vane 101*a* and causes the ends to warp. Because the ends of the vane 101*a* become warped, the toner is guided toward the axial ends of the vane 101*a* (that is, toward the axial ends of the photoconductor 32).

Because the toner is guided toward the axial ends, the toner is supplied to the axial ends of the photoconductor 32, the ends being where the toner tends to be insufficient, so that the toner can prevent the paper powder from passing through the cleaning blade 100. The width of the holding portion 101*b* is preferably shorter than that of the vane 101*a*, and is the same or wider than the axial image formation area of the photoconductor 32.

While illustrated in FIG. 6 is an embodiment in which the both ends of the vane 101*a* are not supported by the holding portion 101*b*, only one of the ends may be left unsupported. Because the conveying coil 102 conveys the conveyed toner axially, a sufficient amount of toner is supplied downstream in the conveying direction. On the downstream side of the conveying direction of the conveying coil 102, therefore, the toner can become attached more easily to the collection vane 101 and the like indirectly. Because a certain amount of toner becomes attached to the photoconductor 32 and the cleaning blade 100, the trouble of the paper powder passing through described above occurs less frequently. For this reason, only the end of the vane 101*a* on the upstream side of the conveying direction of the conveying coil 102 may be left unsupported by the holding portion 101*b*.

Figure 7:
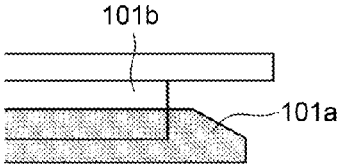
FIG. 7 is a schematic illustrating an end of a collection vane according to the third embodiment.

A part of the unsupported end of the vane 101*a*, being unsupported by the holding portion 101*b*, may be configured thinner than the remaining part of the vane 101*a*, or chamfered as illustrated in FIG. 7, so that the part is allowed to warp more easily.

Figure 8:
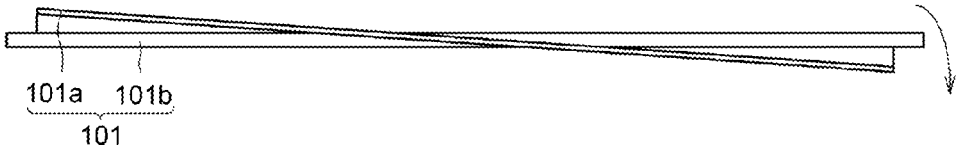
FIG. 8 is a schematic of a cleaning device according to a fourth embodiment of the present invention.

FIG. 8 is a schematic illustrating a collection vane according to a fourth embodiment of the present invention.

In the collection vane 101 according to the fourth embodiment, a spiral-shaped vane 101*a* is mounted on the holding portion 101*b*. The collection vane 101 according to the fourth embodiment conveys the toner scraped off from the cleaning blade 100 in the axial direction, as well as in the direction toward the conveying coil 102 (in the direction of the arrow Z in FIG. 2), by the rotations of the spiral-shaped vane 101*a*.

The vane 101*a* conveys the toner axially in the reverse direction of the direction in which the conveying coil 102 conveys the toner, and the toner is conveyed upstream in the conveying direction of the conveying coil 102. The toner can therefore be supplied upstream in the conveying direction of the conveying coil 102 where the toner tends to be insufficient. In this manner, the trouble of the passing paper powder can be prevented.

Figure 9:
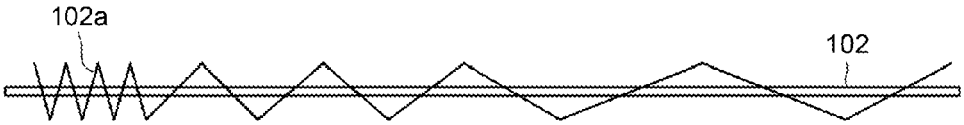
FIG. 9 is a schematic diagram of the cleaning device according to the fourth embodiment.

The pitch of the spiral of the conveying coil 102 may be configured unequal in the axial direction, as illustrated in FIG. 9. By making the pitch smaller on the upstream side 102*a* in the conveying direction where the toner tends to be insufficient, the toner is allowed to stay more on the upstream side of the conveying coil 102 in the conveying direction. As an alternative to the configuration in which the conveying coil 102 has an axial spiral shape as described in the fourth embodiment, a paddle member may be provided on the upstream side 102*a*. In this manner, the part of the conveying coil 102 with the paddle member can be provided with a conveying capability in the direction of the conveying coil 102 (in the direction of the arrow Z in FIG. 2).

Figure 10:
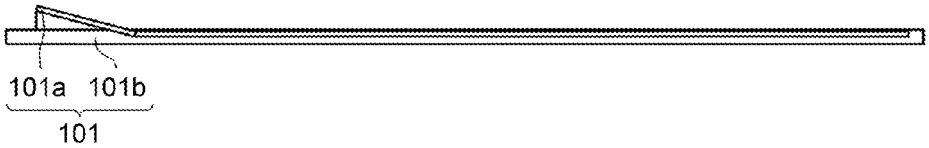
FIG. 10 is a schematic of a cleaning device according to a fifth embodiment of the present invention.

FIG. 10 is a schematic illustrating a collection vane according to a fifth embodiment of the present invention.

The collection vane 101 according to the fifth embodiment has a structure with a vane 101*a* one end of which is provided with an inclination. Only the end provided with the inclination has conveying capability for conveying the toner in the axial direction. In the embodiment, the inclination is provided only to one end of the vane 101*a*, but the inclination may be provided to both ends.

Figure 11:
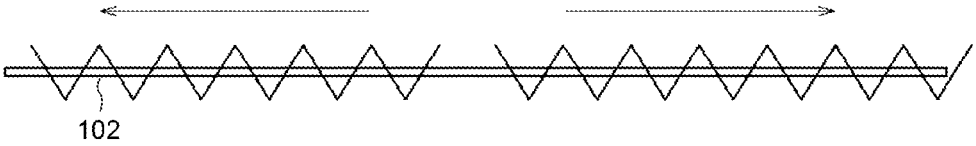
FIG. 11 is a schematic illustrating a general structure of a cleaning device according to a sixth embodiment of the present invention.

In a sixth embodiment of the present invention illustrated in FIG. 11, the conveying coil 102 conveys the toner axially to both sides, with their border at the axial center. The toner conveyed to the axial ends is returned to the developing unit 34, or collected into a collection container. The toner conveyed to the sides may be returned to the developing unit 34, or collected into the collection container from the both sides.

With this structure for conveying the toner to the axial ends, the issue of insufficient toner at the axial ends can be addressed. The border at which the conveying direction is reversed is not limited to the axial center. For example, the border may be positioned at one third of the axial length of the conveying coil, the length being that from one end of the conveying coil 102 in the axial direction, and the direction in which the toner is conveyed may be reversed from this point on. Furthermore, in consideration of deterioration of toner caused by a high temperature environment, the border at which the conveying direction is reversed may be set in such a manner that the toner on a side that is more likely to be heated is conveyed to the collection container, and the toner on the side that is not affected by the heat is returned to the developing unit 34.

In addition to the configuration explained above, the conveying coil 102 according to a seventh embodiment of the present invention may be rotated forwardly and reversely, while switching the directions, so that the directions in which the toner is conveyed are switched alternatingly. In such a configuration, the conveying coil 102 regularly performs the operation of supplying the toner to the end where the toner is insufficient by temporarily being rotated in the reverse direction, being reverse with respect to the ordinary rotating direction.

If the driving system of the conveying coil 102 is configured to operate in association with the photoconductor 32, the photoconductor 32 cannot be rotated reversely during an image formation. The operation of reversely rotating the conveying coil 102 is therefore performed while image formation is not performed, to supply the toner to the side where there is insufficient toner.

In this example, if the photoconductor 32 is reversely rotated for a long time, the toner may become scattered around the photoconductor 32. The photoconductor 32 cannot therefore be operated reversely for a long time.

Figure 12A:
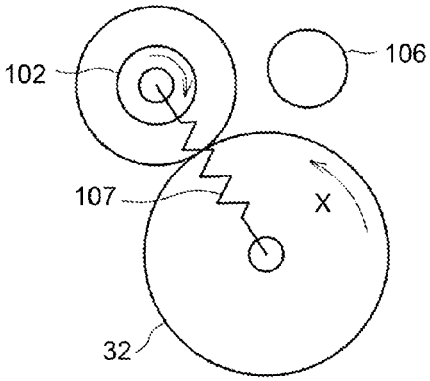
FIGS. 12A and 12B are schematics illustrating a general structure of a cleaning device according to a seventh embodiment of the present invention.
Figure 12B:
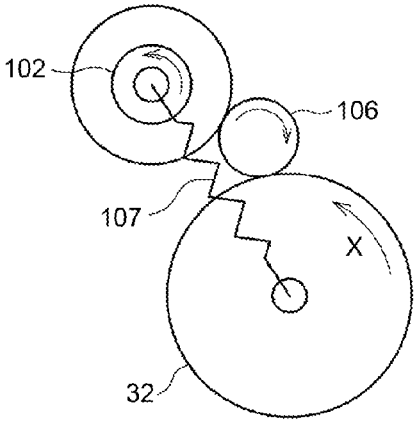

To address this issue, the rotating direction of the photoconductor 32 may be changed using an idler gear 106, an example of which is illustrated in FIGS. 12A and 12B. To rotate the conveying coil 102 forwardly, as illustrated in FIG. 12A, the photoconductor 32 is driven without the idler gear 106 between the conveying coil 102 and the photoconductor 32. By driving the conveying coil 102 via the idler gear 106, the conveying coil 102 can be rotated reversely, while keeping the photoconductor 32 being rotated forwardly, as illustrated in FIG. 12B.

In other words, in a structure in which the conveying coil 102 has the driving source, the idler gear 106 prevents the photoconductor 32 from being rotated reversely by being driven by the reversely rotating conveying coil 102, and can keep the photoconductor 32 rotated forwardly. In a structure in which the photoconductor 32 has the driving source, the forwardly rotating photoconductor 32 can cause the conveying coil 102 to rotate reversely by driving the conveying coil 102 via the idler gear 106.

By using the idler gear 106, the time for which the conveying coil 102 is rotated reversely can be extended, even in a structure in which the photoconductor 32 is driven in association with the conveying coil 102.

As a way to engage the idler gear 106, the engagement between the conveying coil 102 and the photoconductor 32 that are kept abutting against each other by a spring 107 may be separated once using a driving means such as an actuator. The idler gear 106 may then be inserted between the conveying coil 102 and the photoconductor 32, and reengage the conveying coil 102 and the photoconductor 32. If this separating and engaging operation is performed during the image forming operation, defects such as uneven image density may occur due to the variance in the load of the photoconductor 32. Therefore, it is preferable for this operation to be performed while no image formation is performed, or between image forming operations.

A friction wheel may be used instead of the idler gear 106. Furthermore, the idler gear 106 may also be moved inside of a space provided between the photoconductor 32 and the conveying coil 102 during the forward rotation. This configuration can omit the structure for separating the photoconductor 32 and the conveying coil 102.

It is particularly effective to perform this reverse operation of the conveying coil 102 when the toner is not sufficiently attached to the cleaning blade 100, e.g., when an image forming operation is performed for the first time after the image forming apparatus 1 is started, or when an image occupying a small area of the recording sheet on which the image is printed is output successively. This reverse operation is also particularly effective in an extreme environment causing more toner to pass through the cleaning blade, for example, in a highly humid high temperature environment, or in a low temperature environment. The reverse operation may also be performed regularly when a cumulative image formation time becomes equal to or more than a predetermined time.

Such conditions and the timing for causing the reverse operation of the conveying coil 102 may be determined by measuring the ambient temperature, or by detecting the ratio of an image with respect to the recording sheet on which the image is to be formed, or the cumulative image formation time.

Figure 13:
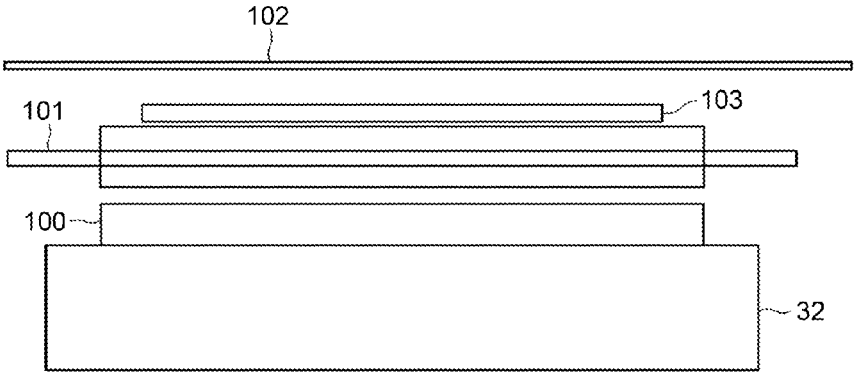
FIG. 13 is a schematic illustrating a general structure of a cleaning device according to an eighth embodiment of the present invention.

FIG. 13 illustrates a configuration according to an eighth embodiment of the present invention. In the cleaning device according to the eighth embodiment, the partitioning member 103 is shorter in the axial direction of the photoconductor 32 and the like than the collection vane 101, and the partitioning member 103 is absent at positions corresponding to the axial ends of the collection vane 101. The other components are the same as those according to the first embodiment, so that explanations thereof are omitted herein.

Because the ends of the partitioning member 103 are shorter, part of toner conveyed from the collection vane 101 is not carried into the conveying coil 102, and returned to the surface of the photoconductor 32 or the cleaning blade 100. In this manner, the issue of toner shortage can be addressed. In FIG. 13, the lengths of both ends of the partitioning member 103 are represented shorter, but only the length of the upstream end in the toner conveying direction that is in the axial direction of the conveying coil 102 may be shorter.

Figure 14A:
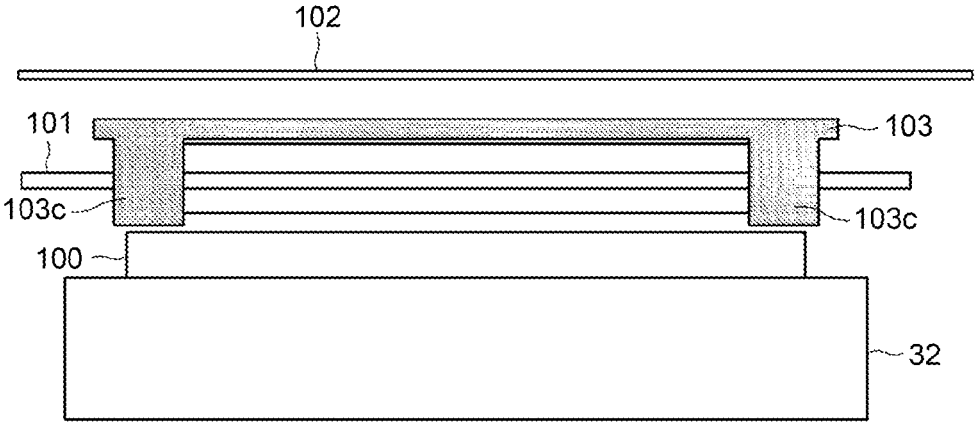
FIGS. 14A and 14B are schematics illustrating a general structure of a cleaning device according to a ninth embodiment of the present invention.
Figure 14B:
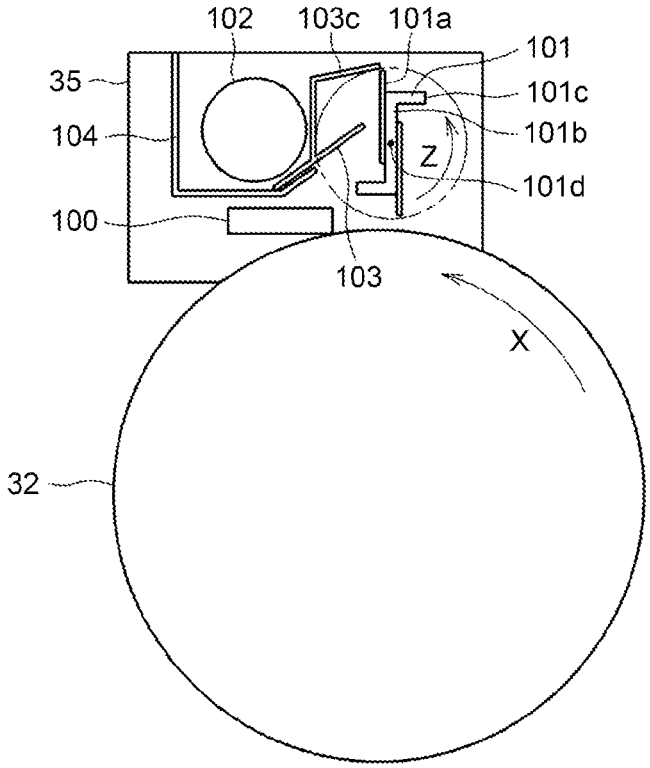
Figure 15:
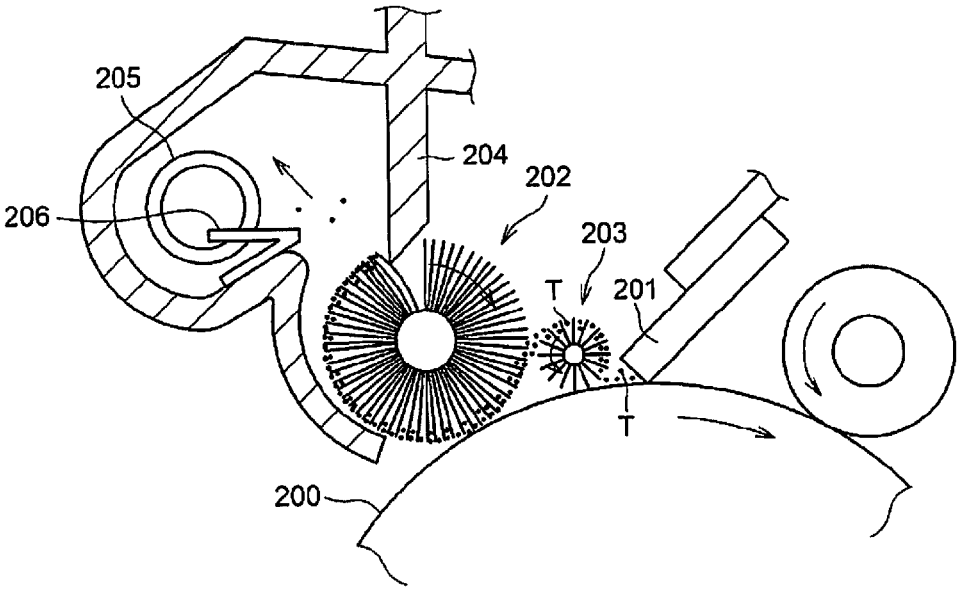
FIG. 15 is a schematic illustrating a general structure of a conventional cleaning device.

FIGS. 14A and 14B illustrate a configuration according to a ninth embodiment of the present invention. In the ninth embodiment, a wall 103*c* is provided to each axial end of the partitioning member 103, as illustrated in FIG. 14A. Because the walls 103*c* are provided, when the toner is moved from the collection vane 101 onto the partitioning member 103, the walls 103*c* block the toner at the respective axial ends, and part of the toner is returned to the surface of the photoconductor 32 or the cleaning blade 100. In this manner, the issue of toner shortage at the axial ends of the photoconductor 32 is addressed. If the axial ends are completely covered by the respective walls 103*c*, the toner will not be collected at all at the axial ends. Therefore, the axial ends have some part without the walls 103*c*, outside of the walls 103*c*.

The height of the wall 103*c* can be changed as appropriate. The walls 103*c* may be provided only to one of the axial ends, without limitation to both ends, or may be provided to a position corresponding to a position of the photoconductor 32 where the paper powder tends to be generated more.

Some embodiments of the present invention are explained herein, but the present invention is not limited to the embodiments described above, and various modifications are still possible with the scope not deviating from the spirit of the present invention.

The image forming unit according to the present invention is not limited to the monochrome image forming unit illustrated in FIG. 1, and may be a color image forming unit, copier, printer, facsimile, or multifunction peripheral including two or more of the functions of the copier, the printer, and the facsimile.

The cleaning device according to the present invention is explained to clean the photoconductor 32, but may also be used as a cleaning device for cleaning the intermediate transfer belt, for example.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A cleaning device comprising:

a member to be cleaned having a surface that moves;

a cleaning member that cleans the surface of the member to be cleaned;

a conveying member that conveys a substance removed from the surface of the member to be cleaned by the cleaning member to outside of the cleaning device;

a collecting member that is rotatably configured, has a surface for carrying the substance, and conveys the substance toward the conveying member; and a partitioning member that guides the substance from the collecting member to the conveying member, the collecting member including:

a conveying portion that carries and conveys the substance;

a holding portion that holds the conveying portion; and a protrusion that protrudes toward an upstream side of the holding portion in a rotating direction of the collecting member, wherein the partitioning member is placed in such a manner that one end of the partitioning member faces the rotating collecting member, and the other end faces the conveying member, and the conveying portion and the protrusion of the collecting member are brought into contact with the partitioning member by the rotation of the collecting member.

2. The cleaning device according to claim 1, wherein the partitioning member is flexible, and becomes warped when the partitioning member is brought into contact with and pressed by the collecting member by the rotation of the collecting member.

3. The cleaning device according to claim 2, wherein the partitioning member is fixed to a housing of the cleaning device, and a pressing force of the collecting member against the partitioning member works in a direction causing the partitioning member to be pressed against the housing.

4. The cleaning device according to claim 1, wherein the collecting member is rotated in a counter direction of a direction in which the surface of the member to be cleaned moves.

5. The cleaning device according to claim 1, wherein the collecting member is not in contact with the member to be cleaned.

6. The cleaning device according to claim 1, wherein the partitioning member and the conveying portion are flexible, and the partitioning member is less rigid than the collecting member.

7. The cleaning device according to claim 1, wherein the conveying portion and the holding portion both extend in an axial direction of the member to be cleaned, and at least one axial end of the conveying portion is longer than the holding portion.

8. The cleaning device according to claim 1, wherein the conveying portion and the holding portion both extend in an axial direction of the member to be cleaned, and the conveying portion has a conveying capability for conveying the substance in the axial direction.

9. The cleaning device according to claim 8, wherein an axial conveying direction of the conveying portion is reversal of a conveying direction of the conveying member.

10. The cleaning device according to claim 8, wherein the conveying portion has a border at which a conveying direction of the substance is switched, and conveys the substance to one axial direction on one side of the border, and to the other axial direction on the other side of the border.

11. The cleaning device according to claim 8, wherein the axial conveying direction of the conveying portion is capable of being switched between one axial direction and another axial direction that is opposite to the one axial direction.

12. An image forming apparatus comprising the cleaning device according to claim 11, wherein the axial conveying direction is switched based on information such as ambient environment such as humidity and temperature, on whether any image forming operation is currently performed, on a ratio of an area of a recording medium occupied by an image formed on the recording medium, and on a cumulative image formation time.

13. An image forming unit comprising the cleaning device according to claim 11, wherein the axial conveying direction is switched when the image forming unit is started or when the image forming unit performs first image formation.

14. The cleaning device according to claim 1, wherein a wall preventing the substance to be removed from being guided from the collecting member to the conveying member is provided to one axial part of the partitioning member.

15. An image forming apparatus comprising the cleaning device according to claim 1.

16. The cleaning device according to claim 1, wherein the protrusion is non-planar in relation to the holding portion.

17. The cleaning device according to claim 1, wherein the protrusion is substantially perpendicular in relation to the holding portion.

18. The cleaning device according to claim 1, wherein the holding portion and the protrusion form an S-like shape.

19. A cleaning device comprising:

a member to be cleaned having a surface that moves;

a cleaning member that cleans the surface of the member to be cleaned;

a conveying member that conveys a substance removed from the surface of the member to be cleaned by the cleaning member to outside of the cleaning device;

a collecting member that is rotatably configured, has a surface for carrying the substance, and conveys the substance toward the conveying member; and a partitioning member that guides the substance from the collecting member to the conveying member, the collecting member including:

a conveying portion that carries and conveys the substance;

a holding portion that holds the conveying portion; and a protrusion that protrudes toward an upstream side of the conveying portion in a rotating direction of the collecting member, wherein the partitioning member is placed in such a manner that one end of the partitioning member faces the rotating collecting member, and the other end faces the conveying member, and the conveying portion and the protrusion of the collecting member are brought into contact with the partitioning member by the rotation of the collecting member, and the conveying portion and the holding portion both extend in an axial direction of the member to be cleaned, and at least one axial end of the conveying portion is longer than the holding portion.

20. A cleaning device comprising:

a member to be cleaned having a surface that moves;

a cleaning member that cleans the surface of the member to be cleaned;

a conveying member that conveys a substance removed from the surface of the member to be cleaned by the cleaning member to outside of the cleaning device;

a collecting member that is rotatably configured, has a surface for carrying the substance, and conveys the substance toward the conveying member; and a partitioning member that guides the substance from the collecting member to the conveying member, the collecting member including:

a conveying portion that carries and conveys the substance; and a holding portion that holds the conveying portion, wherein at least one end of the conveying portion or the holding portion is end-weighted so as to push the substance toward the conveying member, and wherein the partitioning member is placed in such a manner that one end of the partitioning member faces the rotating collecting member, and the other end faces the conveying member, and the conveying portion and the at least one end of the end-weighted conveying portion or the holding portion are brought into contact with the partitioning member by the rotation of the collecting member.

* * * * *